US011574765B2

(12) United States Patent
Jung et al.

(10) Patent No.: US 11,574,765 B2
(45) Date of Patent: Feb. 7, 2023

(54) COIL COMPONENT

(71) Applicant: SAMSUNG ELECTRO-MECHANICS CO., LTD., Suwon-si (KR)

(72) Inventors: Ji Hyung Jung, Suwon-si (KR); Byeong Cheol Moon, Suwon-si (KR); Jae Hun Kim, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 565 days.

(21) Appl. No.: 16/530,417

(22) Filed: Aug. 2, 2019

(65) Prior Publication Data

US 2020/0335256 A1 Oct. 22, 2020

(30) Foreign Application Priority Data

Apr. 19, 2019 (KR) ..... 10-2019-0045930

(51) Int. Cl.
*H01F 27/28* (2006.01)
*H01F 27/29* (2006.01)
(Continued)

(52) U.S. Cl.
CPC ..... *H01F 27/2804* (2013.01); *H01F 27/29* (2013.01); *H01F 27/323* (2013.01);
(Continued)

(58) Field of Classification Search
CPC ..... H01F 27/2804; H01F 2027/2809; H01F 17/0013; H01F 17/0006; H01F 5/003; H01F 27/29; H01F 27/292; H01F 27/323
(Continued)

(56) References Cited

U.S. PATENT DOCUMENTS

2013/0187744 A1 7/2013 Seko et al.
2015/0102891 A1* 4/2015 Yoon ..... H01F 27/2804 336/200
(Continued)

FOREIGN PATENT DOCUMENTS

JP 2016004917 A * 1/2016
JP 2017-073536 A 4/2017
(Continued)

OTHER PUBLICATIONS

Korean Office Action dated May 1, 2020 issued in Korean Patent Application No. 10-2019-0045930 (with English translation).

*Primary Examiner* — Tszfung J Chan
(74) *Attorney, Agent, or Firm* — Morgan, Lewis & Bockius LLP

(57) ABSTRACT

A coil component includes a body having one surface and the other surface facing each other, and having one end surface and the other end surface facing each other in one direction; a supporting substrate embedded in the body; a coil portion disposed on the supporting substrate; a first lead-out portion connected to one end of the coil portion and exposed from the body; and a second lead-out portion connected to the other end of the coil portion and exposed from the body. The coil portion has a first pattern region facing the one surface and a second pattern region facing the other surface, each of the first and second pattern regions extends in the one direction, and a distance of the first pattern region in the one direction is shorter than a distance of the second pattern region in the one direction.

19 Claims, 6 Drawing Sheets

(51) Int. Cl.
*H01F 41/04* (2006.01)
*H01F 41/12* (2006.01)
*H01F 27/32* (2006.01)

(52) U.S. Cl.
CPC ..... *H01F 41/041* (2013.01); *H01F 41/122* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2016/0343489 | A1* | 11/2016 | Horikawa | H01F 27/292 |
| 2017/0018360 | A1* | 1/2017 | Osada | H01G 4/232 |
| 2017/0103848 | A1 | 4/2017 | Yoneda et al. | |
| 2017/0256352 | A1* | 9/2017 | Kido | H01F 27/2804 |
| 2018/0130596 | A1* | 5/2018 | Yamaguchi | H01F 27/245 |
| 2019/0237239 | A1* | 8/2019 | Kato | H01F 27/292 |
| 2019/0326047 | A1* | 10/2019 | Yamaguchi | H01F 17/0013 |
| 2020/0265986 | A1* | 8/2020 | Mizukami | H01F 27/32 |

FOREIGN PATENT DOCUMENTS

| | | | | | |
|---|---|---|---|---|---|
| JP | 2017073536 | A | * | 4/2017 | H01F 17/0013 |
| JP | 2018-170320 | A | | 11/2018 | |
| KR | 10-2013-0086324 | A | | 8/2013 | |
| KR | 10-2015-0044372 | A | | 4/2015 | |
| KR | 10-2015-0114924 | A | | 10/2015 | |
| KR | 10-1670184 | B1 | | 10/2016 | |
| KR | 2018012621 | A | * | 2/2018 | H01F 17/0013 |
| KR | 20180012621 | A | * | 2/2018 | |

* cited by examiner

COIL COMPONENT

CROSS-REFERENCE TO RELATED APPLICATION

This application claims benefit of priority to Korean Patent Application No. 10-2019-0045930 filed on Apr. 19, 2019 in the Korean Intellectual Property Office, the disclosure of which is incorporated herein by reference in its entirety.

TECHNICAL FIELD

The present disclosure relates to a coil component.

BACKGROUND

An inductor, a coil component, may be a typical passive electronic component used in electronic devices, along with a resistor and a capacitor.

With higher performance and smaller sizes gradually implemented in electronic devices, the number of coil components used in electronic devices has been increasing and becoming smaller.

Even when the coil components are miniaturized, it is necessary to secure a volume of a magnetic body in order to ensure the characteristics of the coil components such as inductance, quality coefficient, and the like.

SUMMARY

An aspect of the present disclosure is to provide a coil component capable of increasing a volume of a magnetic body in the same body size.

According to an aspect of the present disclosure, a coil component includes a body having one surface and the other surface facing each other, and having one end surface and the other end surface facing each other in one direction and respectively connecting the one surface and the other surface to each other; a supporting substrate embedded in the body; a coil portion disposed on the supporting substrate; a first lead-out portion embedded in the body, connected to one end of the coil portion, and exposed from the one end surface of the body and from the one surface of the body; and a second lead-out portion embedded in the body, connected to the other end of the coil portion, and exposed from the other end surface of the body and from the one surface of the body. The coil portion has a first pattern region facing the one surface of the body and a second pattern region facing the other surface of the body, the second pattern region spaced apart from the first pattern region. Each of the first and second pattern regions extends in the one direction. A length of the first pattern region in the one direction is shorter than a length of the second pattern region in the one direction.

According to an aspect of the present disclosure, a coil component includes a body having one surface and the other surface facing each other, and having one end surface and the other end surface facing each other in one direction and respectively connecting the one surface and the other surface to each other; a core embedded in the body; a supporting substrate embedded in the body; a coil portion disposed on the supporting substrate; a first lead-out portion embedded in the body, connected to one end of the coil portion, and exposed from the one end surface of the body and from the one surface of the body; and a second lead-out portion embedded in the body, connected to the other end of the coil portion, and exposed from the other end surface of the body and from the one surface of the body. The coil portion has a plurality of turns around the core, and includes first pattern regions between the one surface of the body and the core and second pattern regions between the other surface of the body and the core. Each of the first and second pattern regions substantially linearly extends in the one direction. A length of each of the first pattern regions in the one direction is shorter than a length of each of the second pattern regions in the one direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
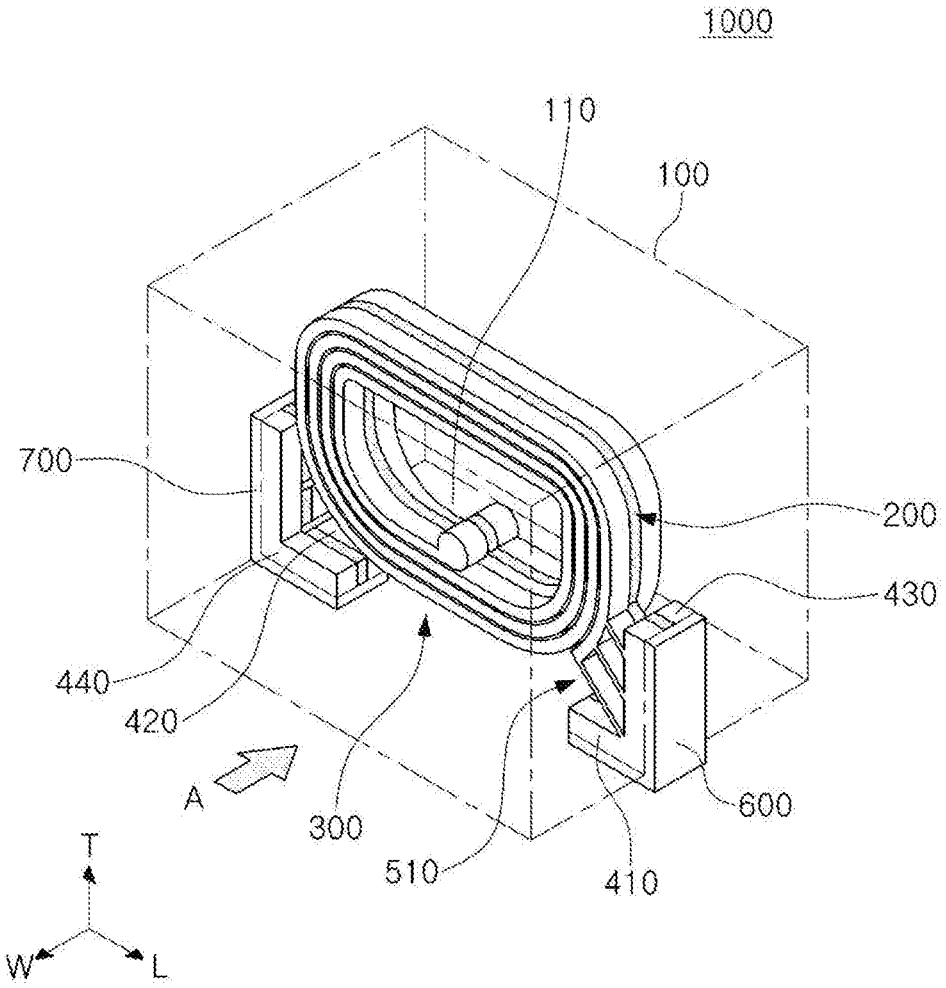
FIG. 1 is a schematic view illustrating a coil component according to an embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (_longitudinal) direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Embodiment

Figure 2:
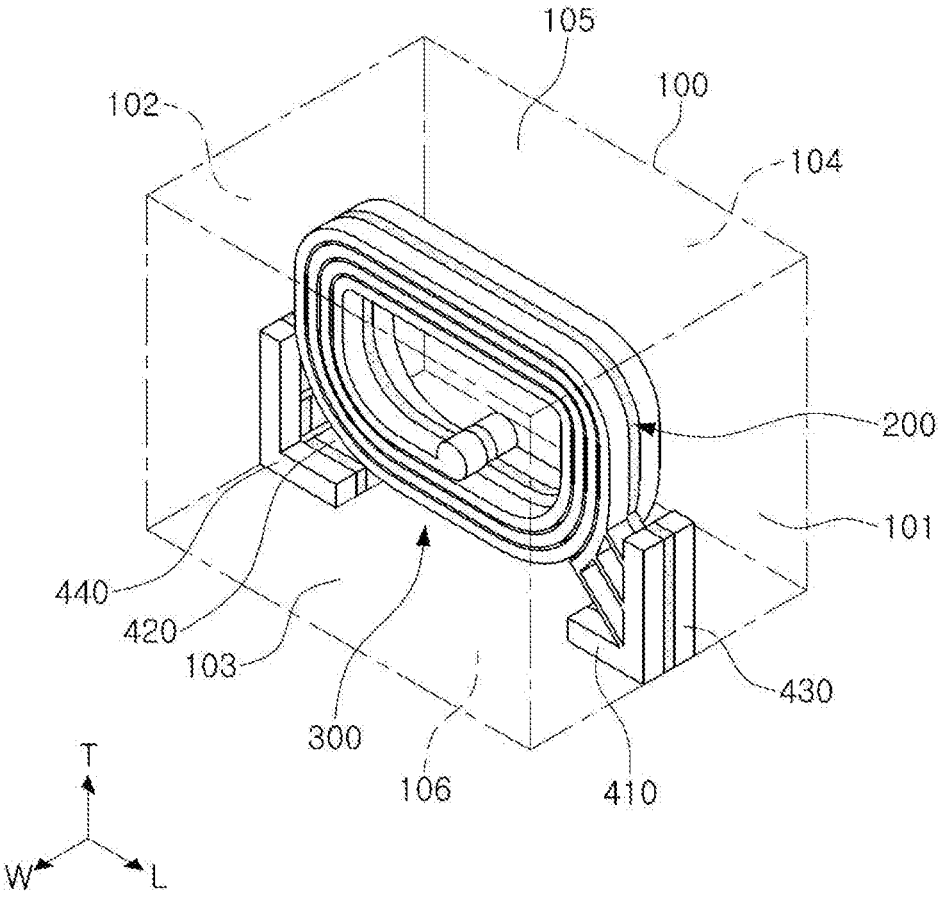
FIG. 2 is a schematic view illustrating a coil component according to an embodiment of the present disclosure, except for some configurations.
Figure 3:
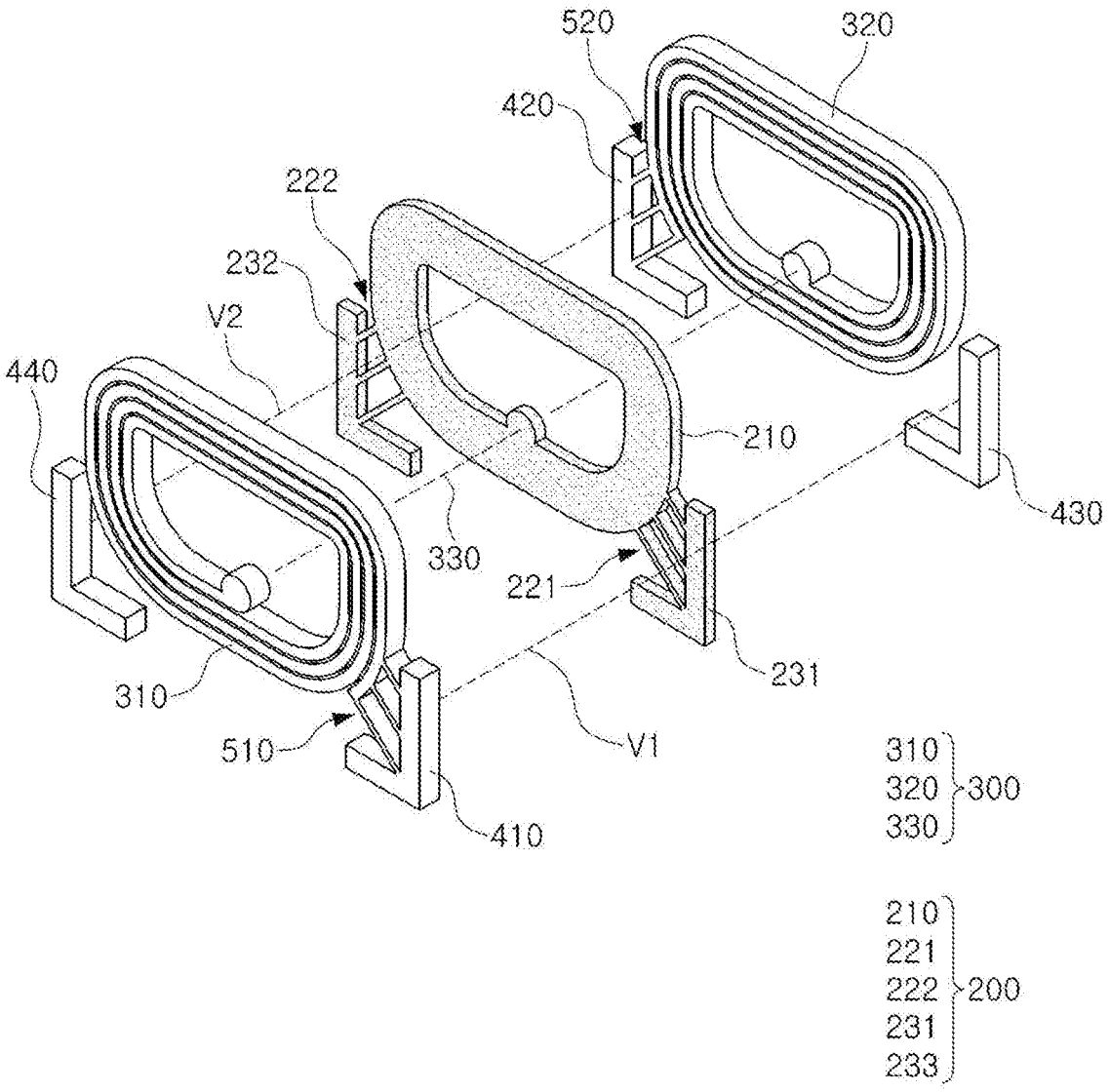
FIG. 3 is a schematic view illustrating a coupling relationship between a supporting substrate and a coil portion applied to an embodiment of the present disclosure.
Figure 4:
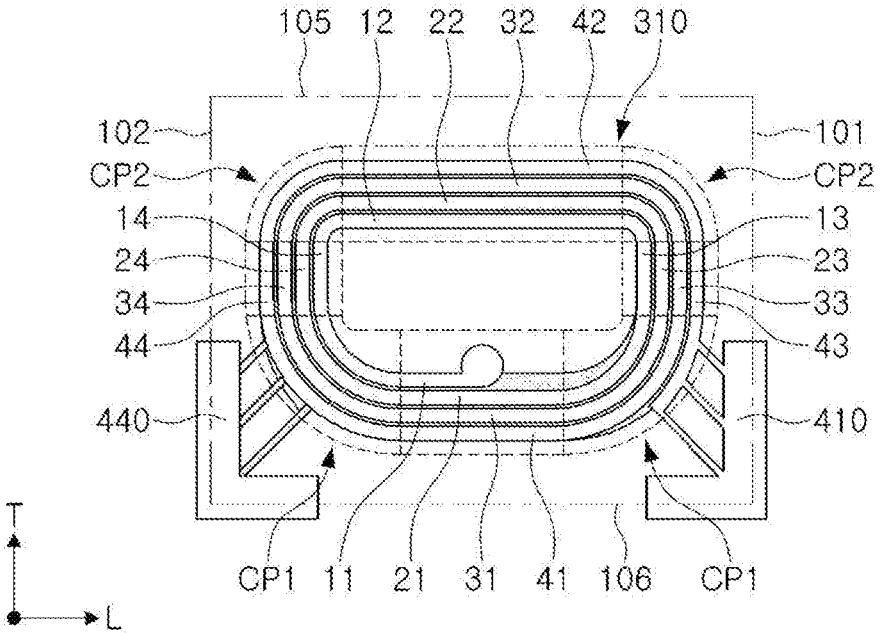
FIGS. 4 and 5 are schematic views of FIG. 1, respectively, when viewed in an A direction.
Figure 5:
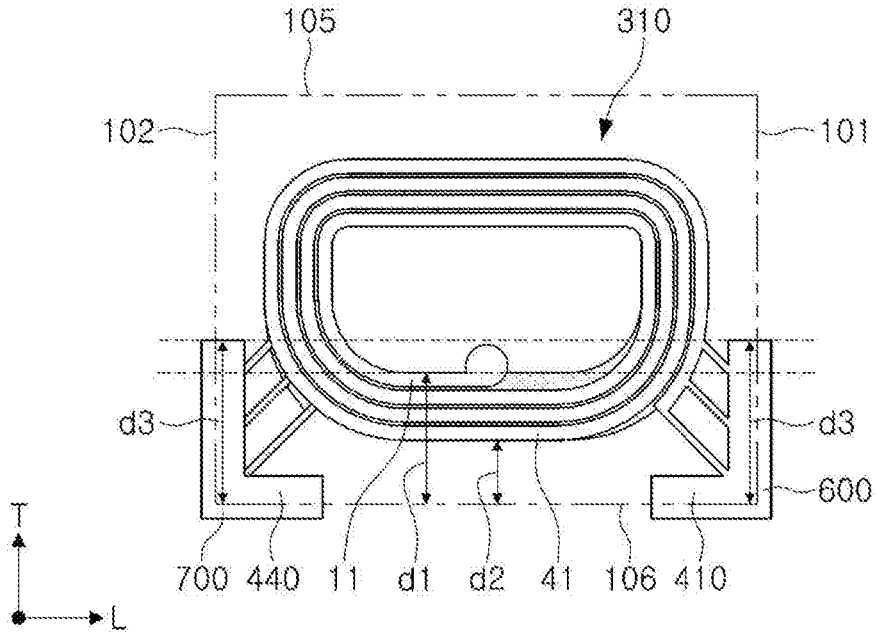

FIG. 1 is a schematic view illustrating a coil component according to an embodiment of the present disclosure. FIG. 2 is a schematic view illustrating a coil component according to an embodiment of the present disclosure, except for some configurations. FIG. 3 is a schematic view illustrating a coupling relationship between a supporting substrate and a coil portion applied to an embodiment of the present disclosure. FIGS. 4 and 5 are schematic views of FIG. 1, respectively, when viewed in an A direction.

Referring to FIGS. 1 to 5, a coil component 1000 according to an embodiment of the present disclosure may include a body 100, a supporting substrate 200, a coil portion 300, and lead-out portions 410 and 420, and may further include connection pattern portions 510 and 520, dummy lead-out portions 430 and 440, and external electrodes 600 and 700, respectively.

The body 100 may form an exterior of the coil portion 1000 according to the present embodiment, and the coil portion 300 may be embedded therein.

The body 100 may be formed in a hexahedral shape as a whole.

Referring to FIGS. 1 and 2, the body 100 may include a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body, and both side surfaces of the body 100 may refer to the third surface 103 and the fourth surface 104 of the body. Further, one surface and the other surface of the body 100 may refer to the sixth surface 106 and the fifth surface 105 of the body 100, respectively.

The body 100 may be formed such that the coil component 1000 according to the present embodiment in which the external electrodes 600 and 700 to be described later are formed has a length of 1.0 mm, a width of 0.6 mm, and a thickness of 0.8 mm, but is not limited thereto. Since the numerical values described above may be merely design values that do not reflect process errors and the like, they should be considered to fall within the scope of the present disclosure to the extent in which ranges may be recognized as the process errors.

The body 100 may include a magnetic material and a resin. Specifically, the body 100 may be formed by stacking one or more magnetic composite sheet containing a resin and a magnetic material dispersed in the resin. The body 100 may have a structure other than a structure in which the magnetic material is dispersed in the resin. For example, the body 100 may be made of a magnetic material such as ferrite.

The magnetic material may be a ferrite powder or a metal magnetic powder.

Examples of the ferrite powder may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter of about 0.1 μm to 30 μm, respectively, but are not limited thereto.

The body 100 may include two or more types of magnetic materials dispersed in the insulating resin. In this case, the term "different types of magnetic materials" means that magnetic materials dispersed in an insulating resin are distinguished from each other by an average diameter, a composition, a crystallinity, and a shape.

The resin may include an epoxy, a polyimide, a liquid crystal polymer, or the like, in a single form or in combined forms, but is not limited thereto.

The body 100 may include a core 110 passing through the coil portion 300 and the supporting substrate 200 to be described later. The core 110 may be formed by filling through-holes of the coil portion 300 with the magnetic composite sheet, but is not limited thereto.

The supporting substrate 200 may be embedded in the body 100. Specifically, the supporting substrate 200 may be embedded in the body 100 to be perpendicular to the one surface 106 of the body 100. The supporting substrate 200 may include a support portion 210, connection portions 221 and 222, and end portions 231 and 232, and may support the coil portion 300, the lead-out portions 410 and 420, the connection pattern portions 510 and 520, and the dummy lead-out portions 430 and 440.

The supporting substrate 200 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the supporting substrate 200 may be formed of an insulating material such as prepreg, Ajinomoto Build-up Film (ABF), FR-4, a bismaleimide triazine (BT) film, a photoimageable dielectric (PID) film, a copper clad laminate (CCL), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the supporting substrate 200 is formed of an insulating material including a reinforcing material, the supporting substrate 200 may provide better rigidity. When the supporting substrate 200 is formed of an insulating material not containing glass fibers, the supporting substrate 200 may be advantageous for reducing a thickness of the overall coil portion 300.

The coil portion 300 may be disposed on the supporting substrate 200. The coil portion 300 may be embedded in the body 100 to manifest the characteristics of the coil portion. For example, when the coil component 1000 of the present embodiment is used as a power inductor, the coil portion 300 may function to stabilize power supply of an electronic device by storing an electric field as a magnetic field and maintaining an output voltage.

The coil portion 300 may be formed on at least one of opposite surfaces of the supporting substrate 200, and may form at least one turn. In the present embodiment, the coil portion 300 may include first and second coil patterns 310 and 320 formed on both surfaces of the supporting substrate 200 facing each other in the width direction W of the body 100, and a via 330 passing through the supporting substrate 200 to connect the first and second coil patterns 310 and 320 to each other.

Each of the first coil pattern 310 and the second coil pattern 320 may have a planar spiral shape forming at least one turn with reference to the core 110. For example, based on the direction of FIGS. 1 and 2, the first coil pattern 310 may form at least one turn with reference to the core 110 on a front surface of the supporting substrate 200. The second coil pattern 320 may form at least one turn with reference to the core 110 on a rear surface of the supporting substrate 200.

The first lead-out portion 410 may be embedded in the body 100, may be connected to the one end of the coil portion 300, and may be exposed to the one end surface 101 of the body 100 and to the one surface 106 of the body 100. The second lead-out portion 420 may be embedded in the body 100, may be connected to the other end of the coil portion 300, and may be exposed to the other end surface 102 of the body 100 and to the one surface 106 of the body 100. The first lead-out portion 410 may be embedded in the body 100, and may be continuously exposed to the first surface 101 and the sixth surface 106 of the body 100. The second lead-out portion 420 may be embedded in the body 100, and may be continuously exposed to the second surface 102 and the sixth surface 106 of the body 100. When the first lead-out portion is continuously exposed to the first surface 101 and the sixth surface 106 of the body 100, a contact area with the first external electrode 600 to be described later may increase to increase coupling force. When the second lead-out portion 420 is continuously exposed to the second surface 102 and the sixth surface 106 of the body 100, a contact area with the second external electrode 700 to be described later may increase to increase coupling force.

Referring to FIG. 3, the first lead-out portion 410 may be disposed on a front surface of a first end portion 231 of the supporting substrate 200, and may be connected to the one end of the first coil pattern 310. The second lead-out portion 420 may be disposed on a rear surface of a second end portion 232 of the supporting substrate 200, and may be connected to the one end of the second coil pattern 320.

The first and second connection pattern portions 510 and 520 may connect both ends of the coil portion 300 and the first and second lead-out portions 410 and 420, respectively. Referring to FIG. 3, the first connection pattern portion 510 may be disposed on a front surface of a first connection portion 221 of the supporting substrate 200, to connect the one end of the first coil pattern 310 and the first lead-out portion 410 to each other. The first connection pattern portion 520 may be disposed on a rear surface of a second connection portion 222 of the supporting substrate 200, to connect the one end of the second coil pattern 320 and the second lead-out portion 420 to each other.

Each of the connection pattern portions 510 and 520 may be formed in a plurality to be spaced apart from each other. For example, the first connection pattern portions 510 may be formed to be spaced apart from each other in a plurality, and the second connection pattern portions 520 may be formed to be spaced apart from each other in a plurality. When the connection pattern portions 510 and 520 were formed in a plurality, connection reliability between the coil patterns 310 and 320 and the lead-out portions 410 and 420 may be improved. For example, even when any one of the plurality of connection pattern portions 510 and 520 is not connected due to a stress or a tolerance, the remaining connection pattern portions 510 and 520 may be used to connect the coil patterns 310 and 320 and the lead-out portions 410 and 420 to each other. The magnetic composite material constituting the body may be filled in the spaced space by disposing the plurality of connection pattern portions 510 and 520 to be spaced apart from each other. Therefore, the coupling force between the body 100 and the connection pattern portions 510 and 520 may be improved.

The first dummy lead-out portion 430 may be disposed on the other surface of the supporting substrate 200, may be spaced apart from the second coil pattern 320, and may be disposed to correspond to the first lead-out portion 410. The second dummy lead-out portion 440 may be disposed on the one surface of the supporting substrate 200, may be spaced apart from the first coil pattern 310, and may be disposed to correspond to the second lead-out portion 420. Referring to FIG. 3, the first dummy lead-out portion 430 may be disposed on the rear surface of the first end portion 231 of the supporting substrate 200 to correspond to the first lead-out portion 410, and may be connected to the first lead-out portion 410 by a first connection via V1 passing through the first end portion 231. The second dummy lead-out portion 440 may be disposed on the front surface of the second end portion 232 of the supporting substrate 200 to correspond to the second lead-out portion 420, and may be connected to the second lead-out portion 420 by a second connection via V2 passing through the second end portion 232. The coupling reliability between the external electrodes 600 and 700 and the coil portion 300 may increase, due to the first and second dummy lead-out portions 430 and 440.

Since the first coil pattern 310, the first lead-out portion 410, and the first connection pattern portion 510 may be integrally formed, no boundary therebetween may occur. Since the second coil pattern 320, the second lead-out portion 420, and the second connection pattern portion 520 may be integrally formed, no boundary therebetween may occur. The above descriptions are merely illustrative, but the present disclosure is not limited to the case in which the above-described structures are formed at different operations to occur a boundary therebetween.

At least one of the coil patterns 310 and 320, the vias 330, the lead-out portions 410 and 420, the dummy lead-out portions 430 and 440, the connection pattern portions 510 and 520, and the connection vias V1 and V2 may include at least one conductive layer.

For example, when the first coil pattern 310, the first lead-out portion 410, the first connection portion 510, the second dummy lead-out portion 440, the via 330, and the connection vias V1 and V2 are formed to face a front surface of the supporting substrate 200 by a plating process, the first coil pattern 310, the first lead-out portion 410, the first connection portion 510 and the second dummy lead-out portion 440 may each include a seed layer and an electroplating layer. The seed layer may be formed by a vapor deposition method such as electroless plating, sputtering, or the like. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is stacked on only one surface of the one electroplating layer. The seed layer of the first coil pattern 310 and the seed layer of the via 330 may be integrally formed, no boundary therebetween may occur, but are not limited thereto. The electroplating layer of the first coil pattern 310 and the electroplating layer of the via 330 may be integrally formed, no boundary therebetween may occur, but are not limited thereto.

Each of the coil patterns 310 and 320, the via 330, the lead-out portions 410 and 420, the dummy lead-out portions 430 and 440, the connection pattern portions 510 and 520, and the connection vias V1 and V2 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The external electrodes 600 and 700 may be spaced apart from each other on the one surface 106 of the body 100, and may be connected to the first and second lead-out portions 410 and 420, respectively. The first external electrode 600 may be in contact with and connected to the first lead-out portion 410 and the first dummy lead-out portion 430, and the second external electrode 700 may be in contact with and connected to the second lead-out portion 420 and the second dummy lead-out portion 440.

The external electrodes 600 and 700 may electrically connect the coil component 1000 to a printed circuit board or the like, when the coil component 1000 according to the present embodiment is mounted on a printed circuit board or the like. For example, the coil component 1000 according to the present embodiment may be mounted such that the sixth surface 106 of the body 100 faces an upper surface of the printed circuit board. In this case, since the external electrodes 600 and 700 may be disposed to be spaced apart from each other on the sixth surface 106 of the body 100, the connection portions of the printed circuit board may be electrically connected to each other.

The external electrodes 600 and 700 may include at least one of a conductive resin layer and an electroplating layer. The conductive resin layer may be formed by printing a conductive paste on a surface of the body 100. The conductive paste may include one or more conductive metals selected from the group consisting of copper (Cu), nickel (Ni), and silver (Ag), and a thermosetting resin. The electroplating layer may include one or more selected from the group consisting of nickel (Ni), copper (Cu), and tin (Sn).

The coil portion 300 may have first pattern regions 11, 21, 31, and 41 arranged to face the one surface 106 of the body 100, and second pattern regions 12, 22, 32, and 42 arranged to face the other surface 105 of the body 100 to be spaced apart from the first pattern regions 11, 21, 31, and 41. In this case, each of the first and second pattern regions 11, 21, 31, 41, 12, 22, 32, and 42 may extend in the longitudinal direction L. For example, each of the first and second pattern regions 11, 21, 31, 41, 12, 22, 32, and 42 may linearly, or substantially linearly, extend in the longitudinal direction L. The term, "substantially," reflects consideration of recognizable process errors which may occur during manufacturing. The first pattern regions 11, 21, 31, and 41 may have the same or substantially the same length in the longitudinal direction L. The second pattern regions 12, 22, 32, and 42 may have the same or substantially the same length in the longitudinal direction L. A length of the first pattern regions 11, 21, 31, and 41 in the longitudinal direction L may be shorter than a length of the second pattern regions 12, 22, 32, and 42 in the longitudinal direction L. Since the first and second lead-out portions 410 and 420 may face the sixth surface 106 of the body 100, as described above, a volume of the magnetic body to face the sixth surface 106 of the body 100 may be reduced. Therefore, in the present embodiment, a deviation in volume of the magnetic body may be minimized by making a length of the first pattern regions 11, 21, 31, and 41, and a length of the second pattern regions 12, 22, 32, and 42 different.

A distance d1 from the first pattern region 11, in an innermost turn among the plurality of turns of the coil portion 300, to the one surface 106 of the body 100 may be shorter than a distance d3 from one end of the first lead-out portion 410, facing the other surface 105 of the body 100, to the one surface 106 of the body 100. When d1 is shorter than d3, the effect of this embodiment in which the length of the first pattern region 11 is shorter than the length of the second pattern region 12, may increase.

The coil portion 300 may further include a third pattern region 13, 23, 33, and 43 disposed to face the one end surface 101 of the body 100, and a fourth pattern region 14, 24, 34, and 44 parallel to the third pattern region 13, 23, 33, and 43 and disposed to face the other end surface 102 of the body 100 to be spaced apart from the third pattern region 13, 23, 33, and 43. For example, unlike the conventional elliptical spiral coil, in the case of this embodiment, the cross-sectional area of the core 110 may increase by forming the third pattern regions 13, 23, 33, and 43 and the fourth pattern regions 14, 24, 34, and 44 in parallel. Each of the third and fourth pattern regions 11, 13, 23, 33, 43, 14, 24, 34, and 44 may extend in the thickness direction T. For example, each of the third and fourth pattern regions 11, 13, 23, 33, 43, and 14, 24, 34, and 44 may linearly, or substantially linearly, extend in the thickness direction T. The third pattern region 13, 23, 33, and 43 may have the same or substantially the same length in the thickness direction T. The fourth pattern region 14, 24, 34, and 44 may have the same or substantially the same length in the thickness direction T.

The coil portion 300 may further include a first curve pattern region CP1 respectively connecting the first pattern regions 11, 21, 31, and 41 and the third and fourth pattern regions 13, 23, 33, 43, 14, 24, 34, and 44, and a second curve pattern region CP2 respectively connecting the second pattern regions 12, 22, 32, and 42 and the third and fourth pattern regions 13, 23, 33, 43, 14, 24, 34, and 44. In this case, a travel distance of the first curve pattern region CP1

(or a length of the first curve pattern region CP1 along a path of the first curve pattern region CP1) is longer than a travel distance of the second curve pattern region CP2 (or a length of the second curve pattern region CP2 along a path of the second curve pattern region CP2). Since the travel distance of the first curve pattern region CP1 may be longer than the travel distance of the second curve pattern region CP2, the cross-sectional area of the core 110 may be secured while reducing a deviation in volume of the magnetic body between the upper and lower portions of the body 100.

Although FIGS. 4 and 5 illustrate only the first pattern regions 11, 21, 31, and 41, the second pattern regions 12, 22, 32, and 42, the third pattern regions 13, 23, 33, and 43, the fourth pattern region 14, 24, 34, and 44, the first curve pattern region CP1, and the second curve pattern region CP2 of the first coil pattern 310, the above description may be applied to the second coil pattern 320, as it is.

Although not illustrated, the coil component 1000 according to the present embodiment may further include an insulation film disposed between each of the supporting substrate 200, the coil patterns 310 and 320, the connection pattern portions 510 and 520, and the lead-out portions 410 and 420, and the body 100. The insulation film may include a known insulating material such as parylene. Any insulating material may be used to form the insulation film, and there is no particular limitation. The insulation film may be formed by vapor deposition or the like, but is not limited thereto, and may be formed by stacking an insulation film on both surfaces of the supporting substrate 200.

Another Embodiment

Figure 6:
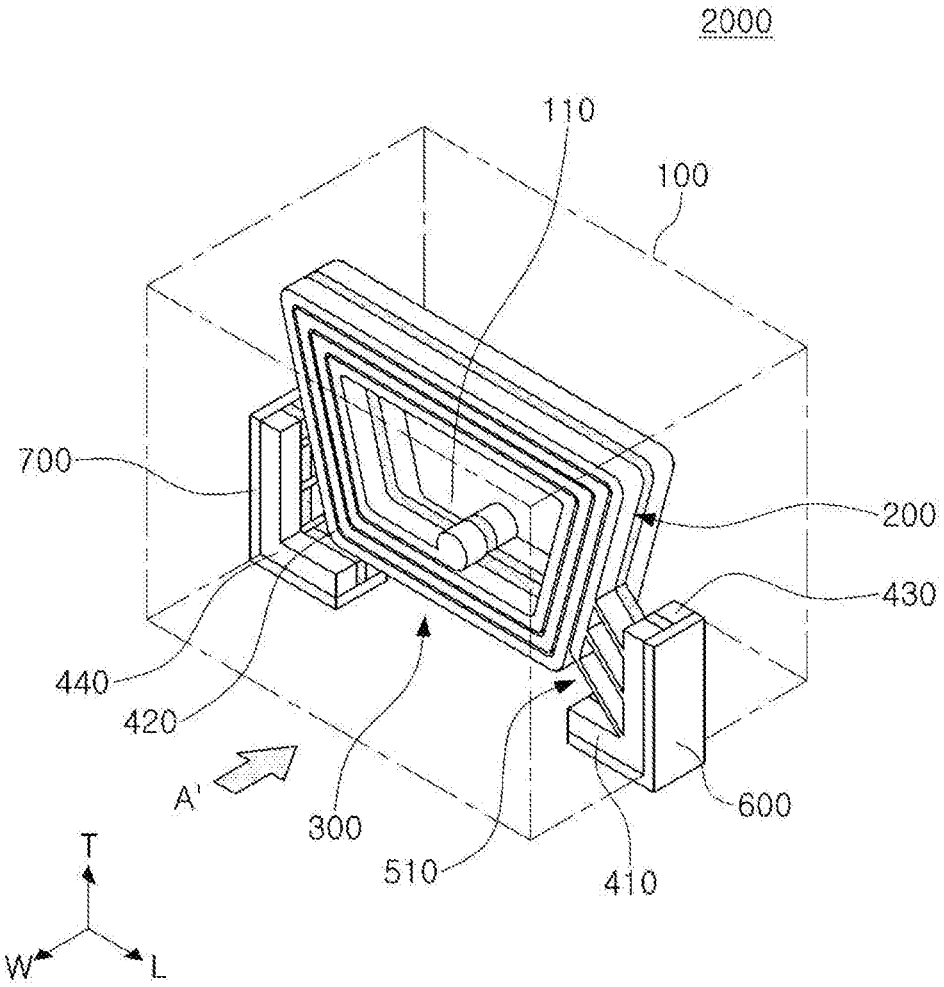
FIG. 6 is a schematic view illustrating a coil component according to another embodiment of the present disclosure.
Figure 7:
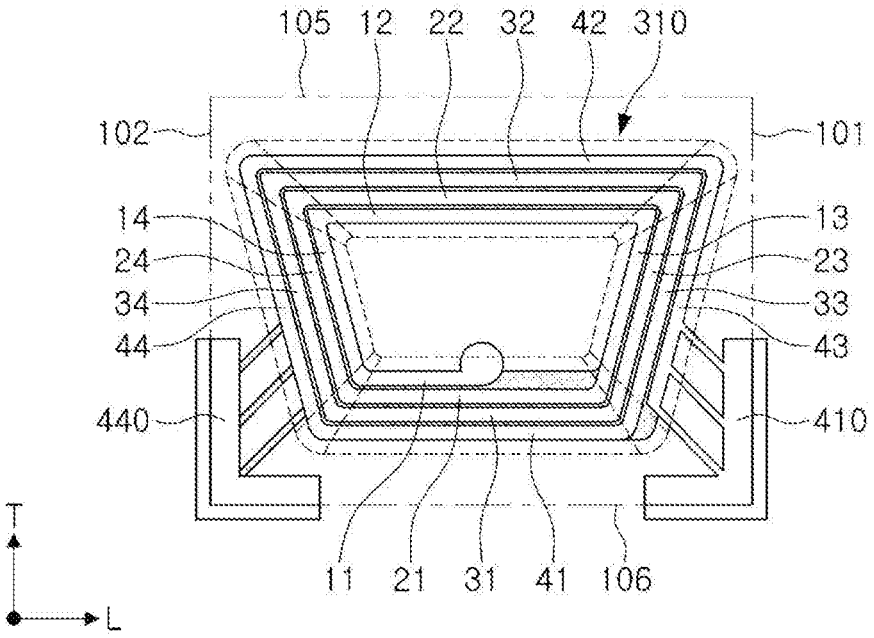
FIG. 7 is a schematic view of FIG. 6, when viewed in an A' direction.

FIG. 6 is a schematic view illustrating a coil component according to another embodiment of the present disclosure. FIG. 7 is a schematic view of FIG. 6, when viewed in an A' direction.

Referring to FIGS. 1 to 5 and FIGS. 6 and 7, a coil component 2000 according to the present embodiment may have a coil portion 300 having a different shape, compared to the coil component 1000 according to the first embodiment of the present disclosure. Therefore, only the shape of the coil portion 300 different from that of the first embodiment of the present disclosure will be described in describing the present embodiment. The remaining configuration of this embodiment may be applied as it is in an embodiment of the present disclosure.

Referring to FIGS. 6 to 7, the coil portion 300 applied to the present embodiment may be formed such that a distance between the third pattern region 13, 23, 33, and 43 and the fourth pattern region 14, 24, 34, and 44 becomes shorter from the other surface 105 of the body 100 toward the one surface 106 of the body 100. For example, referring to FIG. 7, a distance between the third pattern region 13, 23, 33, and 43 and the fourth pattern region 14, 24, 34, and 44 may become shorter from the upper portion of the body 100 toward the lower portion of the body 100. As a result, a cross-section of the core 110 may be formed in an inverted trapezoidal shape as a whole.

The regions in which the first to fourth pattern regions 11, 21, 31, 41, 12, 22, 32, 42, 13, 23, 33, 43, 14, 24, 34, and 44 are connected to each other may be formed to include a curved line. For example, the first to fourth pattern regions 11, 21, 31, 41, 12, 22, 32, 42, 13, 23, 33, 43, 14, 24, 34, and 44, respectively having a straight line, may be formed to form a curved line in a region crossing each other. This may prevent the magnetic flux from concentrating on the crossing area.

According to the present disclosure, the volume of the magnetic body may increase in the same body size.

While example embodiments have been shown and described above, it will be apparent to those skilled in the art that modifications and variations could be made without departing from the scope of the present disclosure as defined by the appended claims.

What is claimed is:

1. A coil component comprising:

a body having a first surface and a second surface facing each other, and having a third surface and a fourth surface facing each other in one direction and respectively connecting the first surface and the second surface to each other;

a supporting substrate embedded in the body;

a coil portion disposed on the supporting substrate;

a first lead-out portion embedded in the body, connected to one end of the coil portion, and exposed from the third surface of the body and from the first surface of the body;

a second lead-out portion embedded in the body, connected to another end of the coil portion, and exposed from the fourth surface of the body and from the first surface of the body;

first connection pattern portions, spaced apart from each other, directly connecting the one end of the coil portion and the first lead-out portion to each other; and second connection pattern portions, spaced apart from each other, directly connecting the another end of the coil portion and the second lead-out portion to each other, wherein the coil portion has a first pattern region facing the first surface of the body, a second pattern region facing the second surface of the body and spaced apart from the first pattern region, a third pattern region facing the third surface, connecting the first pattern region and the second pattern region to each other, and inclined with respect to the first surface, and a fourth pattern region facing the fourth surface, connecting the first pattern region and the second pattern region to each other, and inclined with respect to the first surface, each of the first and second pattern regions extends in the one direction, and a length of the first pattern region in the one direction is shorter than a length of the second pattern region in the one direction.

2. The coil component according to claim 1, wherein the coil portion has a plurality of turns, and a distance from the first pattern region, in an innermost turn among the plurality of turns, to the first surface of the body is shorter than a distance from one end of the first lead-out portion, facing the second surface of the body, to the first surface of the body.

3. The coil component according to claim 1, wherein a distance between the third pattern region and the fourth pattern region becomes shorter from the second surface of the body toward the first surface of the body.

4. The coil component according to claim 3, wherein a region, in which the first to fourth pattern regions are connected to each other, comprises a curved cross-section.

5. The coil component according to claim 1, further comprising a first external electrode and a second external electrode respectively connected to the first and second lead-out portions and spaced apart from each other on the first surface of the body.

6. The coil component according to claim 1, wherein the first lead-out portion is continuously exposed from the third surface of the body and from the first surface of the body, and the second lead-out portion is continuously exposed from the fourth surface of the body and from the first surface of the body.

7. The coil component according to claim 1, wherein the coil portion comprises:

a first coil pattern disposed on one surface of the supporting substrate;

a second coil pattern disposed on another surface of the supporting substrate facing the one surface of the supporting substrate; and a via passing through the supporting substrate and connecting the first and second coil patterns to each other, wherein the first lead-out portion is disposed on the one surface of the supporting substrate and connected to the first coil pattern, and the second lead-out portion is disposed on the another surface of the supporting substrate and connected to the second coil pattern.

8. The coil component according to claim 7, further comprising:

a first dummy lead-out portion disposed on the another surface of the supporting substrate, spaced apart from the second coil pattern, and disposed to correspond to the first lead-out portion; and a second dummy lead-out portion disposed on the one surface of the supporting substrate, spaced apart from the first coil pattern, and disposed to correspond to the second lead-out portion.

9. A coil component comprising:

a body having a first surface and a second surface facing each other, and having a third surface and a fourth surface facing each other in one direction and respectively connecting the first surface and the second surface to each other;

a core embedded in the body;

a supporting substrate embedded in the body;

a coil portion disposed on the supporting substrate;

a first lead-out portion embedded in the body, connected to one end of the coil portion, and exposed from the third surface of the body and from the first surface of the body;

a second lead-out portion embedded in the body, connected to another end of the coil portion, and exposed from the fourth surface of the body and from the first surface of the body;

first connection pattern portions, spaced apart from each other, directly connecting the one end of the coil portion and the first lead-out portion to each other; and second connection pattern portions, spaced apart from each other, directly connecting the another end of the coil portion and the second lead-out portion to each other, wherein the coil portion has a plurality of turns around the core, and includes first pattern regions between the first surface of the body and the core, second pattern regions between the second surface of the body and the core, third pattern regions disposed between the third surface of the body and the core, respectively connecting the first pattern regions and the second pattern regions to each other, and inclined with respect to the first surface, and fourth pattern regions disposed between the fourth surface of the body and the core, respectively connecting the first pattern regions and the second pattern regions to each other, and inclined with respect to the first surface, each of the first and second pattern regions substantially linearly extends in the one direction, and in a same turn, a length of the first pattern region in the one direction is shorter than a length of the second pattern region in the one direction.

10. The coil component according to claim 9, wherein a distance from an innermost one among the first pattern regions, to the first surface of the body is shorter than a distance from one end of the first lead-out portion, facing the second surface of the body, to the first surface of the body.

11. The coil component according to claim 9, wherein the coil portion further comprises:

third pattern regions each substantially linearly extending; and fourth pattern regions each substantially linearly extending.

12. The coil component according to claim 11, wherein a distance between an innermost one of the third pattern regions and an innermost one of the fourth pattern regions becomes shorter from the second surface of the body toward the first surface of the body.

13. The coil component according to claim 9, further comprising a first external electrode and a second external electrode respectively connected to the first and second lead-out portions and spaced apart from each other on the first surface of the body.

14. The coil component according to claim 9, wherein the coil portion comprises:

a first coil pattern disposed on one surface of the supporting substrate;

a second coil pattern disposed on another surface of the supporting substrate facing the one surface of the supporting substrate; and a via passing through the supporting substrate and connecting the first and second coil patterns to each other;

a first dummy lead-out portion disposed on the another surface of the supporting substrate, spaced apart from the second coil pattern, and disposed to correspond to the first lead-out portion; and a second dummy lead-out portion disposed on the one surface of the supporting substrate, spaced apart from the first coil pattern, and disposed to correspond to the second lead-out portion, wherein the first lead-out portion is disposed on the one surface of the supporting substrate and connected to the first coil pattern, and the second lead-out portion is disposed on the another surface of the supporting substrate and connected to the second coil pattern.

15. A coil component comprising:

a body having a first surface and a second surface facing each other, and having a third surface and a fourth surface facing each other in one direction and respectively connecting the first surface and the second surface to each other;

a supporting substrate embedded in the body;

a coil portion disposed on the supporting substrate;

a first lead-out portion embedded in the body, connected to one end portion of the coil portion, and exposed from the third surface of the body and from the first surface of the body;

a second lead-out portion embedded in the body, connected to another end portion of the coil portion, and exposed from the fourth surface of the body and from the first surface of the body;

first connection pattern portions, spaced apart from each other, directly connecting the one end portion of the coil portion and the first lead-out portion to each other; and second connection pattern portions, spaced apart from each other, directly connecting the another end portion of the coil portion and the second lead-out portion to each other, wherein the coil portion has a first pattern region facing the first surface of the body and a second pattern region facing the second surface of the body and spaced apart from the first pattern region, each of the first and second pattern regions extends in the one direction, and a length of the first pattern region in the one direction is shorter than a length of the second pattern region in the one direction.

16. The coil component according to claim 15, wherein the coil portion has a plurality of turns, and a distance from the first pattern region, in an innermost turn among the plurality of turns, to the first surface of the body is shorter than a distance from one end of the first lead-out portion, facing the second surface of the body, to the first surface of the body.

17. The coil component according to claim 15, wherein the coil portion further comprises:

a third pattern region facing the third surface of the body; and a fourth pattern region parallel to and spaced apart from the third pattern region, and facing the fourth surface of the body.

18. The coil component according to claim 17, wherein the coil portion further comprises a first curve pattern region respectively connecting the first pattern region and the third and fourth pattern regions, and a second curve pattern region respectively connecting the second pattern region and the third and fourth pattern regions, wherein, in any one turn of the coil portion, a length of the first curve pattern region is longer than a length of the second curve pattern region.

19. The coil component according to claim 15, wherein the coil portion further comprises:

a third pattern region facing the third surface of the body, and a fourth pattern region facing the fourth surface of the body and spaced apart from the third pattern region, wherein a distance between the third pattern region and the fourth pattern region becomes shorter from the second surface of the body toward the first surface of the body.

* * * * *